US007164876B2

(12) United States Patent
Yoo et al.

(10) Patent No.: US 7,164,876 B2
(45) Date of Patent: Jan. 16, 2007

(54) PHOTORECEPTOR UNIT

(75) Inventors: Yong-baek Yoo, Suwon-si (KR); Chung-guk Baek, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 204 days.

(21) Appl. No.: 10/841,620

(22) Filed: May 10, 2004

(65) Prior Publication Data

US 2005/0084288 A1 Apr. 21, 2005

(30) Foreign Application Priority Data

Oct. 16, 2003 (KR) ..... 10-2003-0072073

(51) Int. Cl.
*G03G 15/00* (2006.01)
*G03G 21/00* (2006.01)

(52) U.S. Cl. ..... 399/116; 399/110

(58) Field of Classification Search ..... 399/117, 399/116, 113, 110, 121, 122, 123; 347/138, 347/152

See application file for complete search history.

(56) References Cited

U.S. PATENT DOCUMENTS 4,761,667 A * 8/1988 Miyai et al. ..... 399/113
6,674,982 B1 * 1/2004 Saitoh et al. ..... 399/110
2004/0009008 A1 * 1/2004 Park et al. ..... 399/116
2005/0002687 A1 * 1/2005 Jung et al. ..... 399/110
2005/0078979 A1 * 4/2005 Yoo et al. ..... 399/117

FOREIGN PATENT DOCUMENTS

JP 59-058444 A * 4/1984
JP 60-179753 A * 9/1985
JP 61-230159 10/1986
JP 2-300769 12/1990
JP 04-328770 A * 11/1992
JP 2000-147980 5/2000
JP 2002-328586 11/2002

* cited by examiner

*Primary Examiner*—Sophia S. Chen
(74) *Attorney, Agent, or Firm*—Stanzione & Kim, LLP

(57) ABSTRACT

A photoreceptor unit includes a photoconductive drum assembly, a housing to enclose the photoconductive drum assembly to be rotatable therein, a handgrip rotatably formed on the housing, and a stopper to prevent the housing with the photoconductive drum assembly from becoming lopsided toward its preponderant side of the housing with respect to a center of rotation of the handgrip when the housing is lifted up by the handgrip.

44 Claims, 8 Drawing Sheets

PHOTORECEPTOR UNIT

CROSS-REFERENCE TO RELATED APPLICATIONS

This application claims the benefit of Korean Patent Application No. 2003-72073 filed Oct. 16, 2003, in the Korean Intellectual Property Office, the disclosure of which is incorporated herein by reference.

BACKGROUND OF THE INVENTION

1. Field of the Invention

The present invention relates to a photoreceptor unit to form an image to be transferred onto a transfer medium.

2. Description of the Related Art

As is generally known in the art, a printing machine, such as a laser printer or a photocopier, comprises a photoreceptor unit for the development of images.

A photoreceptor unit is valid during a limited period of time and is required to be replaced at the end of its life cycle in order to develop and produce clean images. For the facilitation of the replacement, a photoreceptor unit is generally modularized to be replaced as a whole with a new one.

A modularized photoreceptor unit may include a photoconductive drum assembly, a housing for enclosing and protecting part of the photoconductive drum assembly and a handgrip.

The photoreceptor unit may additionally include a charging unit, a cleaning unit and a used toner recovering unit.

The photoreceptor unit should expose a photoconductive drum to face a developer unit for the development of toner images. The other units, such as the charging unit, the cleaning unit and the used toner recovering unit, should be placed on an opposite side of the photoconductive drum with respect to the developer unit not to face the developer unit. Accordingly, the photoreceptor unit has a center of gravity displaced from a center of rotation of the photoconductive drum.

The handgrip is provided to be used when the modularized photoreceptor unit is mounted into or separated from a printer mainframe. A user can mount the photoreceptor unit into the printer mainframe using the handgrip. Also, the user can pull out the photoreceptor unit from the printer mainframe using the handgrip.

However, if the handgrip is not provided at the center of gravity of the photoreceptor unit, it will be difficult for the user to lift up or move the photoreceptor unit with one hand. If the handgrip is rotatably formed, the photoreceptor unit will be lopsided toward its center of gravity. Thus, the user has to hold the photoreceptor unit with both hands.

It is also likely that the photoreceptor unit may be mounted into the printer mainframe in a lopsided condition. As a result, the photoconductive drum or the printer mainframe may be damaged during the mounting of the photoreceptor unit.

SUMMARY OF THE INVENTION

In order to solve the above drawbacks and/or other problems associated with the conventional arrangement it is an aspect of the present invention to provide a photoreceptor unit with an improved structure that can compensate for an eccentric center of gravity to ensure a stable placement.

Additional aspects and advantages of the invention will be set forth in part in the description which follows and, in part, will be obvious from the description, or may be learned by practice of the invention.

The above and/or other aspects and features of the present invention can be substantially realized by providing a photoreceptor unit comprising: a photoconductive drum assembly; a housing to enclose the photoconductive drum assembly to be rotatable therein; a handgrip rotatably formed on the housing; and a stopper to prevent the housing with the photoconductive drum assembly from being positioned lopsided toward its preponderant side based on a center of rotation of the handgrip when a user lifts up the housing using the handgrip.

The stopper may include a step section formed to protrude from an outer surface of the housing and a stopping curb provided on the handgrip to correspond to the step section.

It is an aspect that the step section and the stopping curb contact each other at an opposite side of an eccentric center of gravity of the housing with respect to the center of rotation of the handgrip.

The handgrip may include a grip bar with a grip section and a pair of link bars rotatably connected to both sides of the housing. It is an aspect that at least one of the link bars have the stopping curb.

The link bars are bent at a predetermined angle in their longitudinal direction. Additionally, the stopping curb may be formed at a bent portion of the link bars.

Additionally, the housing may include: opposing first and second vertical walls to rotatably support the photoconductive drum assembly; and a protective wall to connect the vertical walls to surround an outer periphery of the photoreceptor drum assembly and to provide a plurality of openings. The stopper may include a step section formed on the first vertical wall to protrude from the first vertial wall and a stopping curb formed on the handgrip to correspond to the step section.

The first vertical wall may include a base wall, a projecting wall projecting outwardly by a predetermined height from the base wall, and a horizontal wall to connect the base wall and the projecting wall. Preferably, the step section should be the horizontal wall.

The projecting wall and the horizontal wall are formed to correspond to a receiving space within the housing to receive a driving gear rotatably connected to one side of the photoconductive drum assembly.

The center of gravity of the housing is disposed on a side of the housing provided with the charging unit and the used toner recovering unit to rotate the housing with respect to the center of gravity of the handgrip. The stopper should operate on another side of the housing opposite to the center of gravity with respect to the center of rotation of the handgrip.

Fixed shafts displaced from the center of rotation of the photoconductive drum assembly can be formed on both sides of the housing to rotatably support the handgrip.

The housing may additionally include brackets connected to both sides thereof so as to prevent the handgrip from being separated from the fixed shafts.

A spring member that elastically supports the handgrip may be further provided to prevent the handgrip from being in close contact with the housing.

The spring member may include a plate spring provided on one side of the housing to elastically contact and support the handgrip. The spring member may be placed between each bracket and the housing.

A damping bar and a spring may be provided within the bracket to elastically support a transfer unit mounted on a top of the housing.

When the housing is inserted into an image forming apparatus and the transfer unit is placed on the top of the housing, the handgrip is pressed down by the transfer unit and comes close to the housing. When the transfer unit is separated from the housing, the handgrip is slightly separated from the housing by a reaction force of the spring member to allow a user to easily grip the handgrip.

According to another aspect of the present invention, a photoreceptor unit comprises a photoconductive drum assembly; a housing to enclose the photoconductive drum assembly to be rotatable therein; a handgrip rotatably connected to the housing; and a spring member to resiliently support the handgrip to prevent the handgrip in a laid-down position from being in tight contact with the casing by its own weight.

A pair of brackets may be connected to both sides of the casing so as to prevent the separation of the handgrip and the spring member is placed between the housing and at least one of the brackets.

The stopper may be placed on the housing at a predetermined distance from a hinge point of the handgrip.

The handgrip may be bent to be disposed at a predetermined distance from the hinge point.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
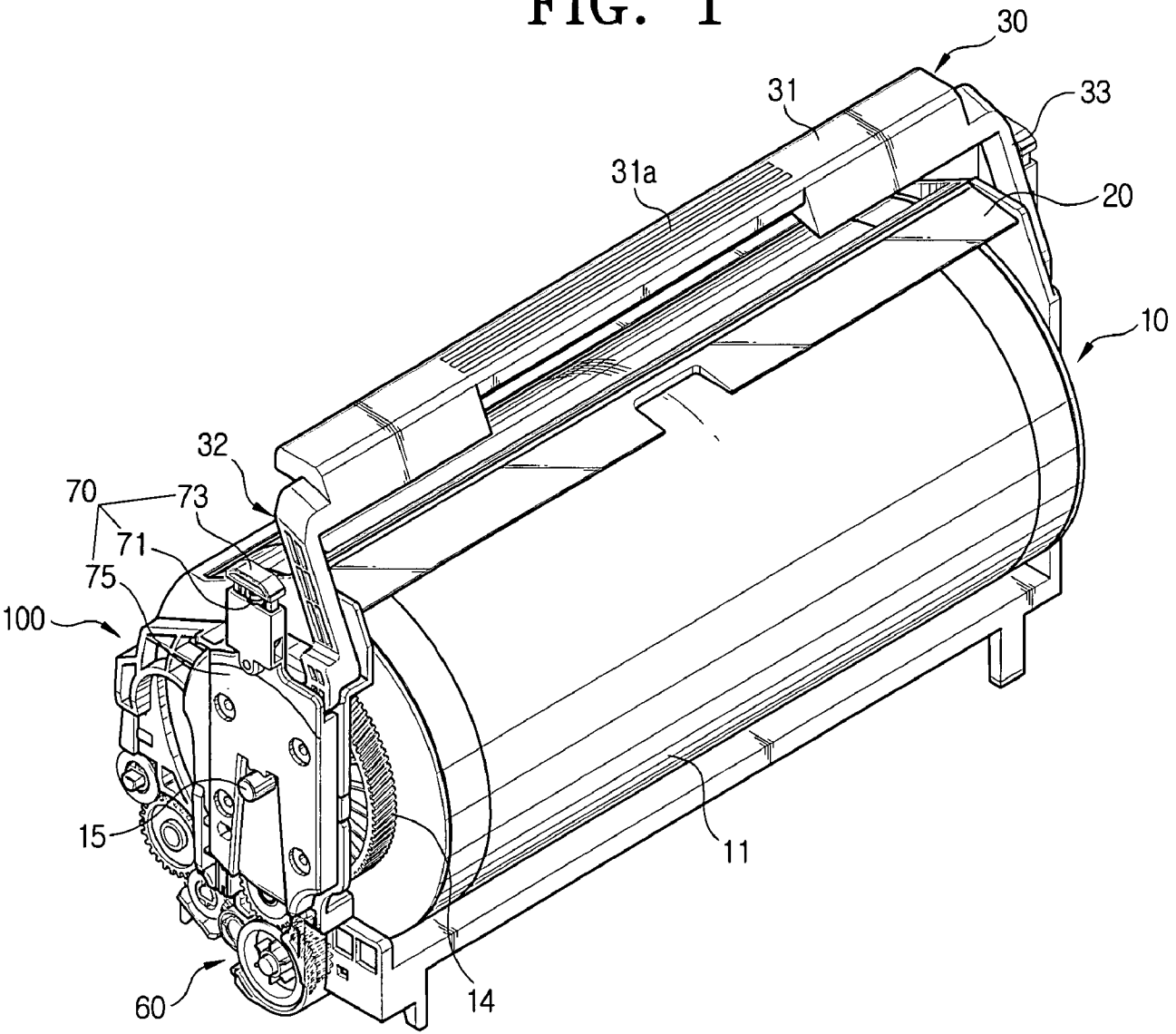
FIG. 1 is a perspective view of a photoreceptor unit according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 2:
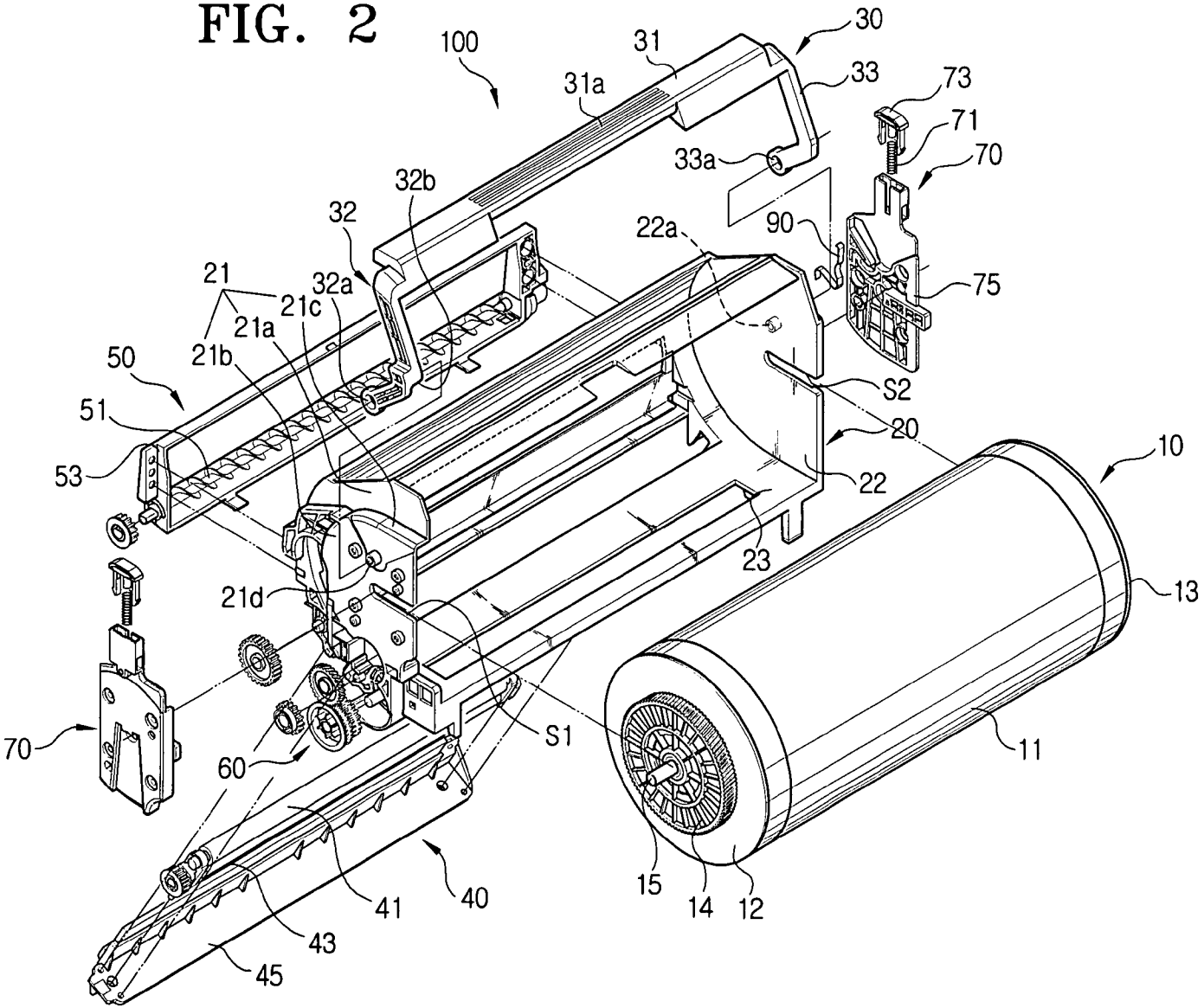
FIGS. 2 and 3 are exploded perspective views of the photoreceptor unit shown in FIG. 1.
Figure 3:
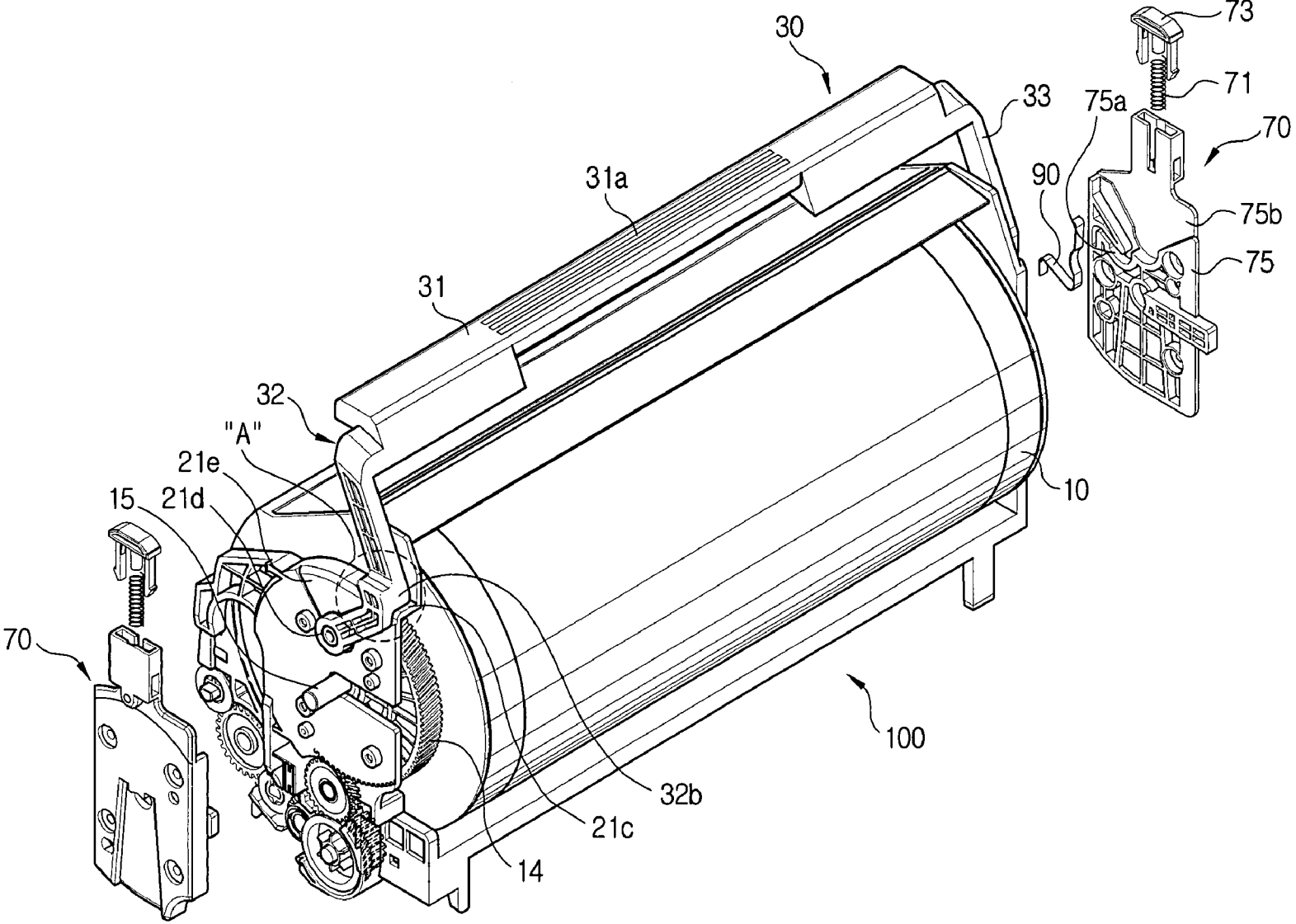

FIG. 1 is a perspective view of a photoreceptor unit 100 according to an embodiment of the present invention. FIG. 2 is an exploded perspective view of the photoreceptor unit 100. FIG. 3 is a partially exploded perspective view with parts broken away from the photoreceptor unit 100.

Referring to FIGS. 1 to 3, a photoconductive drum assembly 10 can be rotatably mounted into a housing 20. The photoconductive drum assembly 10 can be partially surrounded by the housing 20 to be partially exposed. A handgrip 30 can be rotatably connected to the housing 20. A user can raise the handgrip 30 to pull out the photoreceptor unit 100. The handgrip 30 can be laid down when the photoreceptor unit 100 is mounted again in its original position within an image forming apparatus.

The photoconductive drum assembly 10 may include a drum body 11 made of a suitable material, such as aluminum, and first and second flanges 12 and 13 connected respectively to left and right sides of the drum body 11. A driving gear 14 can be connected to the first flange 12. In this embodiment of the present invention, the driving gear 14 and the first flange 12 can be integrated to form a single body. A shaft 15 rotatably connected to the first and second flanges 12 and 13 can be coupled to first and second vertical walls 21 and 22 on both sides of the housing 20.

The housing 20 may include the first and second vertical walls 21 and 22 and a protective wall 23 to connect the two vertical walls 21 and 22 to each other. The first and second vertical walls 21 and 22 can be formed to be opposite to each other. The first and second vertical walls 21 and 22 may have guide slots S1 and S2, respectively, into which the shaft 15 can be inserted. The first vertical wall 21 may include a base wall 21*a* and a projecting wall 21*b*. The base wall 21*a* and the projecting wall 21*b* can be connected by a horizontal wall 21*c* which is perpendicular thereto. The projecting wall 21*b* may protrude outwardly from the base wall 21*a* by a predetermined height to form a step. The projecting wall 21*b* may be stepped from the base wall 21*a* by a height corresponding to a thickness of the driving gear 14 in a direction parallel to a rotational axis of the drum body 11 so that the driving gear 14 can be freely received within an inside of the projecting wall 21*b*.

The protective wall 23 can partially surround and protect an outer periphery of the drum body 11 and may have a length corresponding to the length of the photoconductive drum assembly 10. The protective wall 23 may have a plurality of openings. The biggest opening (which is formed with the slots S1 and S2) is provided for the attachment or detachment of the photoconductive drum assembly 10 and for the connection with a developer unit (not shown). The other openings of the protective wall 23 are provided for the installation of a charging unit 40 and a used toner recovering unit 50. In other words, the protective wall 23 can be formed to surround a half of the photoconductive drum assembly 10 as divided based on the shaft 15.

The charging unit 40 may include a charging roller 41 which rotates in contact with the drum body 11 to charge the drum body 11, a cleaning roller 43 to clean the charging roller 41, and a cover 45 coupled to the protective wall 23 of the housing 20 to cover the rollers 41 and 43.

The used toner recovering unit 50 may include an auger 51 and a temporary receiving member 53 to temporarily receive a used toner. The used toner recovering unit 50 can be coupled to the protective wall 23.

The auger 51 and the cleaning roller 43 can rotate by a driving force of the driving gear 14. For this rotation, a gear train 60 with a plurality of gears is provided on the first vertical wall 21 to transfer the driving force of the driving gear 14 to the units 40 and 50. Since the charging unit 40 and the used toner recovering unit 50 are coupled to the protective wall 23, the gear train 60 can be placed at a position close to the protective wall 23.

In addition, a damping member 70 can be attached to each of the first and second vertical walls 21 and 22 of the housing 20. The damping member 70 may include a spring 71, a damping bar 73 and a bracket 75. The damping member 70 can elastically support a transfer unit 80 (see FIG. 8) mounted directly on the photoreceptor unit 100 in an image forming apparatus.

Figure 4:
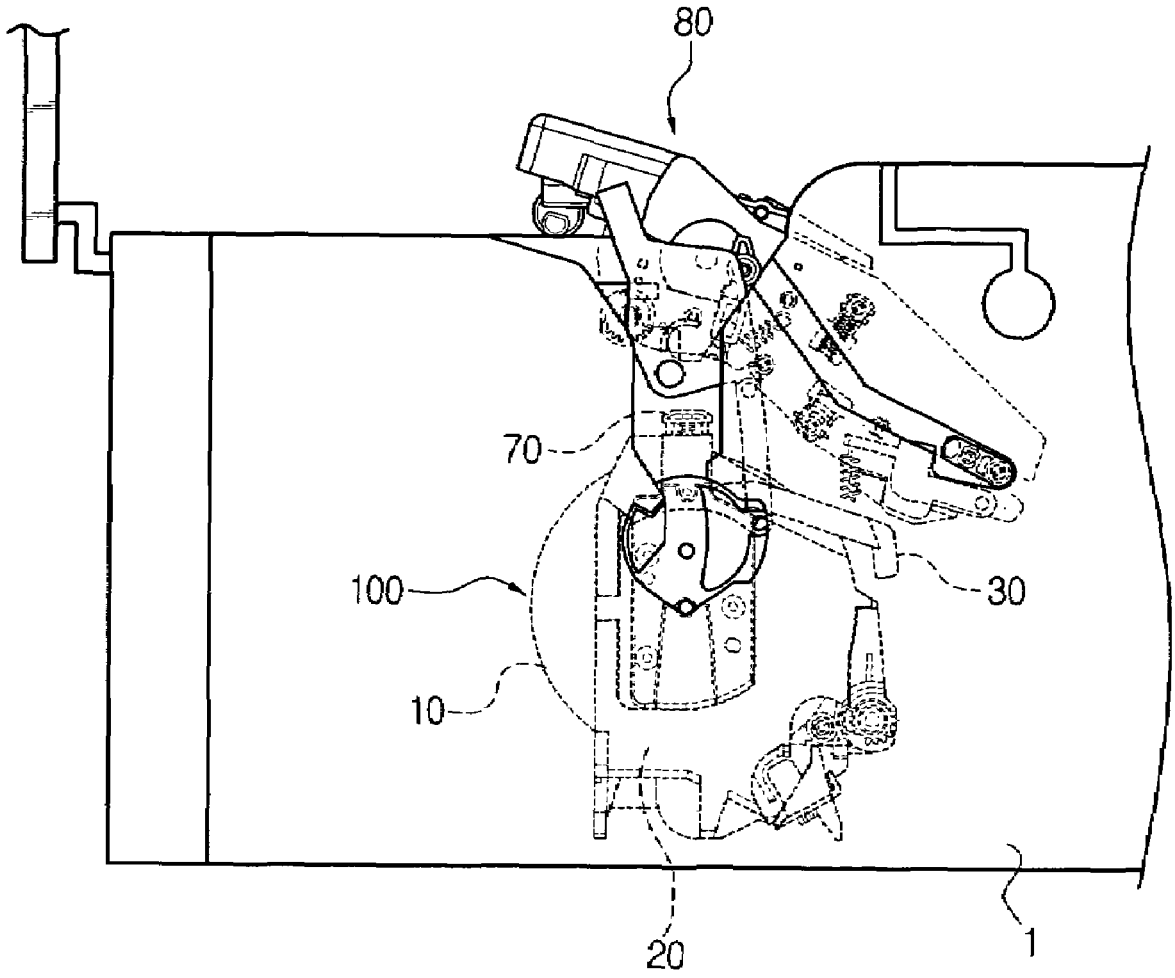
FIG. 4 is a side view of the photoreceptor unit of FIG. 1 which is mounted into an image forming apparatus while not being pressed down by the insertion of a transfer unit.
Figure 5:
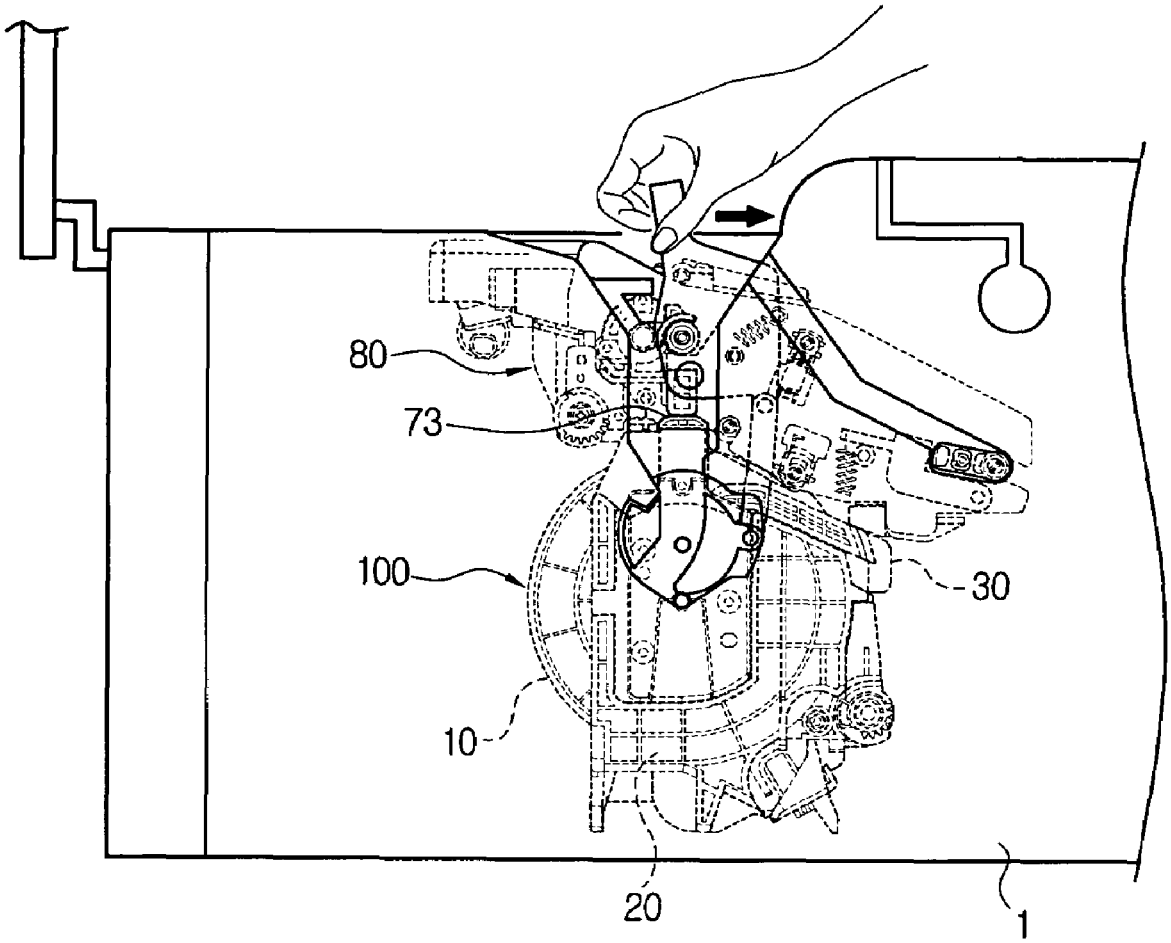
FIG. 5 is a side view of the photoreceptor unit of FIG. 1 which is mounted into an image forming apparatus and also pressed down by a transfer unit placed on a top thereof.

As shown in FIG. 4, with the photoreceptor unit 100 being mounted into the image forming apparatus 1, the transfer unit 80 can be placed on a top of the photoreceptor unit 100. At this time, the transfer unit 80 can be elastically supported by being in contact with the damping member 70 of the photoreceptor unit 100. As shown in FIG. 5, the transfer unit 80 can be supported by the damping bar 73 being pressed down. Accordingly, the photoreceptor unit 100 and the transfer unit 80 can be protected from any impact which may be caused by a direct contact of the two units 100 and 80.

The handgrip 30 may include a grip bar 31 with slot sections 31 a and first and second link bars 32 and 33 extending from both ends of the grip bar 31 and rotatably connected to the housing 20. The link bars 32 and 33 can be integrated with the grip bar 31 to be a single body. The link bars 32 and 33 may be bent in a direction perpendicular to the grip bar 31 and may extend from the grip bar 31. Also, the link bars 32 and 33 may have axial holes 32*a* and 33*a*, respectively, at their ends. Fixed shafts 21*d* and 22*a* formed on the vertical walls 21 and 22 can be rotatably inserted into the axial holes 32*a* and 33*a*, respectively. As explained above, the user can grip and raise the handgrip 30 to pull out the photoreceptor unit 100. Also, the handgrip 30 can be laid down when the photoreceptor unit 100 is placed again in the image forming apparatus.

Figure 6:
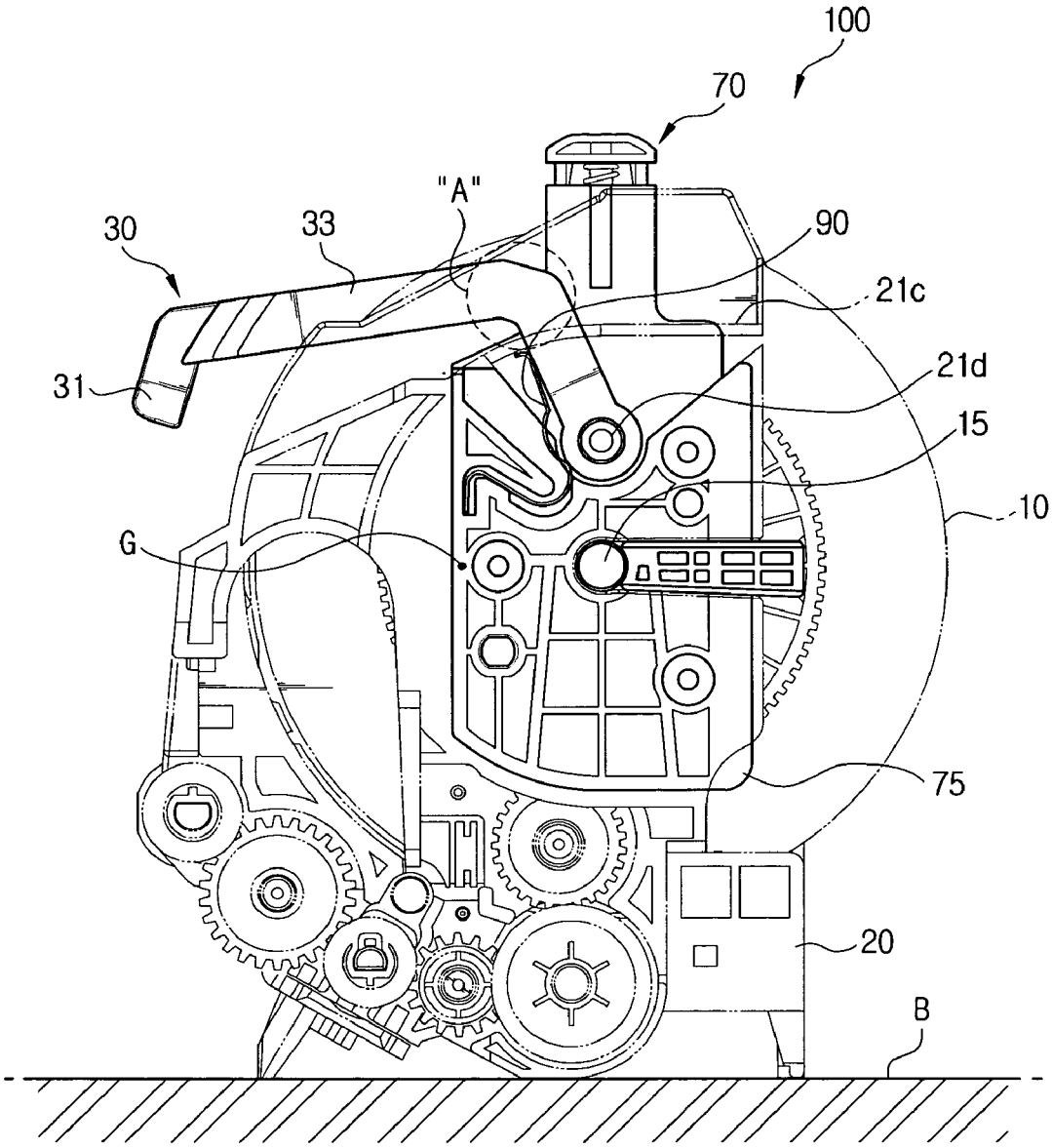
FIG. 6 is a side view showing a state of a handgrip of the photoreceptor unit shown in FIG. 4.

In the photoreceptor unit 100 having the above structure, the photoconductive drum assembly 10 may have its center of gravity in the shaft 15. However, the housing 20 into which the photoconductive drum assembly 10 and the units 40 and 50 are inserted may have a center of gravity eccentric toward a side of the photoreceptor unit 100 provided with the units 40 and 50 and the protective wall 23. In other words, as shown in FIG. 6, the center of gravity G of the photoreceptor unit 100 can be displaced toward the left (in the drawing) from the center of rotation of the photoconductive drum assembly 10, i.e., from the shaft 15. If the user grips and raises the handgrip 30 in such a condition, the photoreceptor unit 100 will tend to turn and be lopsided due to a moment given toward the center of gravity G. To solve this problem, a stopper to prevent the photoreceptor unit 100 from being lopsided by an eccentric force is provided on the handgrip 30 and the housing 20. The stopper may include a stopping curb 32*b* stepped from the first link bar 32 and the horizontal wall 21*c* of the first vertical wall 21. The stopping curb 32*b* can be stepped from the first link bar 32 to correspond to the first vertical wall 21.

Figure 7:
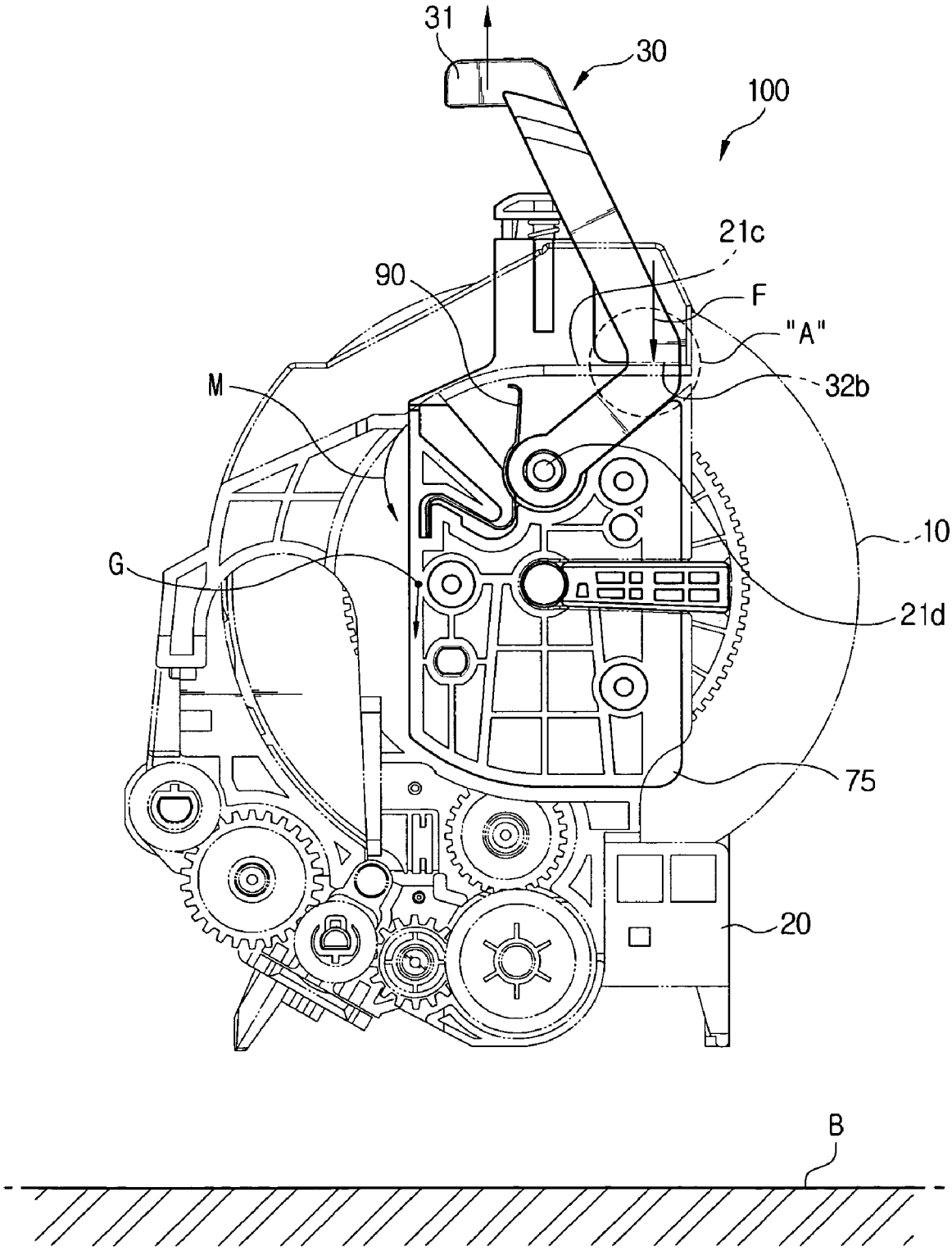
FIG. 7 is a side view of the photoreceptor unit lifted up using a handgrip.

The first and second link bars 32 and 33 can be bent at a predetermined angle in their longitudinal direction. The stopping curb 32*b* can be formed at a bent portion A of the handgrip 30. Accordingly, when the handgrip 30 is raised to lift up the photoreceptor unit 100, the stopper can operate on a side opposite to the center of gravity G with respect to the fixed shaft 21*d*. As shown in FIG. 7, the stopping curb 32*b* can come in contact with the horizontal wall 21*c* on the opposite side of the center of gravity G displaced from the fixed shaft 21*d*. When the user holds the handgrip 30 to lift up the photoreceptor unit 100 from a support surface B, a rotation moment M caused by the eccentric center of gravity G of the photoreceptor unit 100 can be offset by a reaction force F transferred from a portion where the stopping curb 32*b* contacts the horizontal wall 21*c*. Therefore, when lifted up, the photoreceptor unit 100 can be prevented from being lopsided or turned toward a heavier side of the photoreceptor unit 100 with respect to the the center of the fixed shaft 21*d* or 22*a*.

According to this embodiment of the present invention, the fixed shaft 21*d*, which is the center of rotation of the handgrip 30, may be disposed on the housing 20 in a position displaced from the shaft 15. Since the handgrip 30 has its rotation center independent (different) from the center of rotation of the drum assembly 10, its shape and position can be freely designed. Also, there are less limitations in determining the position of the stopper, which facilitates the manufacture of the photoreceptor unit 100.

As explained above, the bent portion A of the handgrip 30 makes the stopper operate on the opposite side of the center of gravity G and reduces a rotation radius of the handgrip 30. Accordingly, the handgrip 30 does not require a large space to be raised. A rotation angle of the handgrip 30, when laid down in its original position, can be minimized. Due to such a structure, it is possible to minimize the space to mount and separate the photoreceptor unit 100 into and from the image forming apparatus 1.

The handgrip 30 can be raised to lift up the photoreceptor unit 100 as shown in FIG. 7. The handgrip 30 can be laid down when the photoreceptor unit 100 is placed on the support surface B as shown in FIG. 6. If the laid-down handgrip 30 closely contacts the housing 20, the user may feel inconvenienced when trying to hold the handgrip 30. Therefore, a spring member 90 may be further provided to prevent the handgrip 30 from being in close contact with the housing 20. The spring member 90 can be provided on either the first vertical wall 21 or the second vertical wall 22 so as to elastically contact and support the link bar 33 of the handgrip 30. According to an aspect of the present invention, the spring member 90 is a plate spring formed in a predetermined shape and is supported by the bracket 75. The bracket 75 has a spring receiving section 75*a* (see FIG. 3) to receive the spring member 90. When being coupled to the housing 20, the bracket 75 may cover the link bars 32 and 33 of the handgrip 30, thereby preventing the handgrip 30 from being separated from the housing 20. In order to control the handgrip 30 to freely rotate even when covered by the bracket 75, a space 75*b* corresponding to the rotation angle of the handgrip 30 can be provided on an inner surface of the bracket 75. Also, an inlet 21*e* corresponding to the rotation angle of the first link bar 32 can be formed on the projecting wall 21*b* of the first vertical wall 21 of the housing 20. The inlet 21*e* defines the rotation angle of the first link bar 32 and also serves as a stopper.

Figure 8:
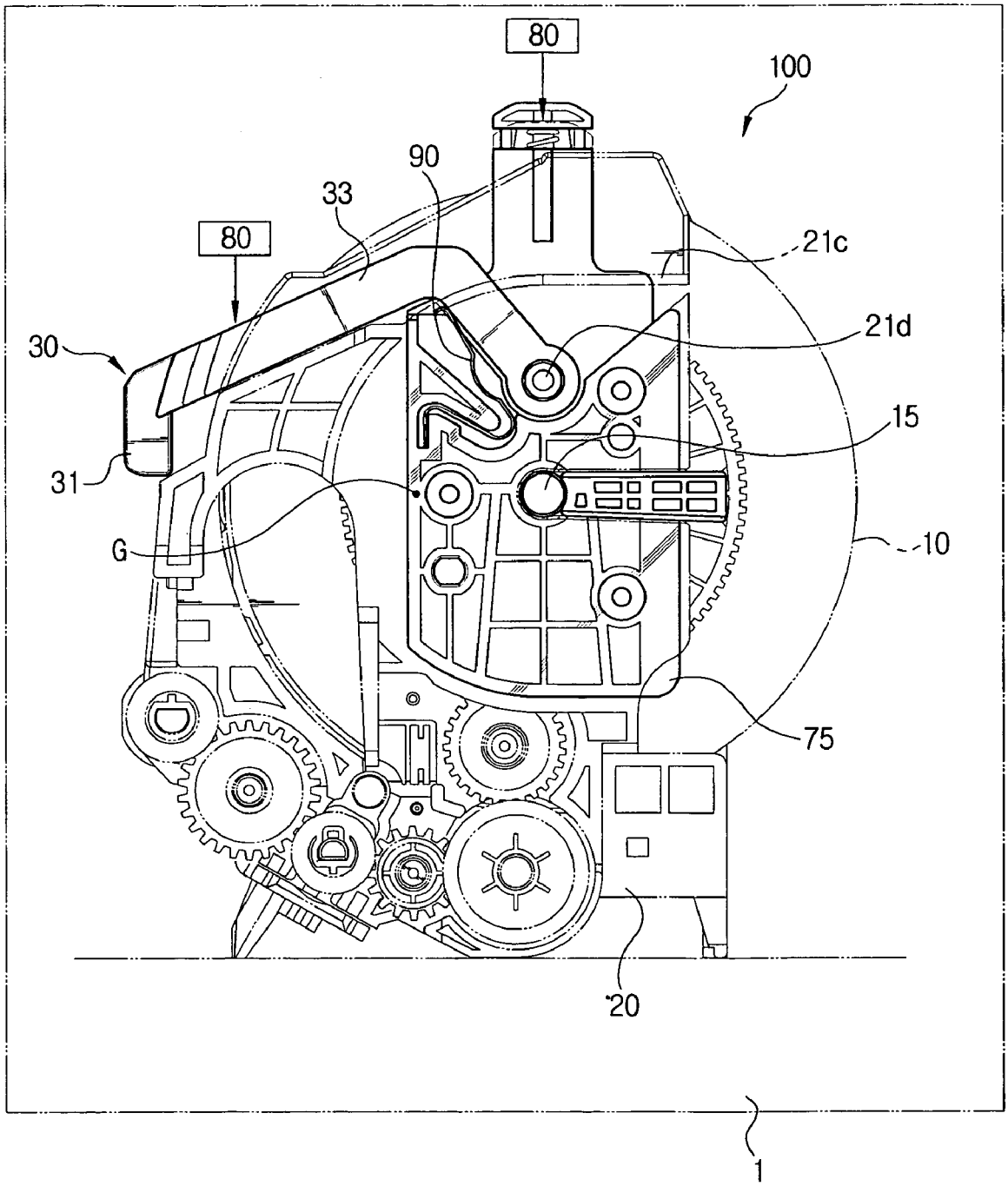
FIG. 8 is a side view showing a state of a handgrip of the photoreceptor unit shown in FIG. 5.

When the transfer unit 80 is placed on the top of the photoreceptor unit 100 within the image forming apparatus 1 as shown in FIG. 5, the handgrip 30 can be laid down by the transfer unit 80. The handgrip 30 comes close to the housing 20 while compressing the spring member 90 as shown in FIG. 8. At this time, the damping bar 73 of the damping member 70 can be also pressed down by the transfer unit 80. As explained above, when the transfer unit 80 is inserted into the image forming apparatus 1, the handgrip 30 can be laid down and comes close to the housing 20, thereby minimizing the space to mount the photoreceptor unit 100 within the image forming apparatus. When the transfer unit 80 is taken out from the image forming apparatus 1, the handgrip 30 can be slightly separated from the housing 20 by the reaction force of the spring member 90 so that the user can easily hold the handgrip 30, without making his or her hands become stained with a toner.

In addition, when the user mounts or separates the photoreceptor unit 100 into or from the image forming apparatus 1 using the handgrip 30, the photoreceptor unit 100 maintains its posture on the support surface B. Therefore, the photoreceptor unit 10 does not contact or damage any other part of the image forming apparatus 1.

According to the present invention, although the center of gravity of the photoreceptor unit is displaced from the center of rotation of the handgrip, the photoreceptor unit does not rotate with respect to the image forming apparatus due to the stopper provided between the handgrip and the housing.

Since the handgrip has its rotation axis in a position which does not coincide with the center of rotation of the photoconductive drum assembly, i.e., on the housing, its shape and position can be freely designed.

The handgrip, when laid down, does not come in close contact with the housing due to the spring member. The spring member enables the user to easily hold the handgrip, without making his or her hands stained.

The foregoing embodiment and advantages are merely exemplary and are not to be construed as limiting the present invention. The present teaching can be readily applied to other types of apparatuses. Also, the description of the embodiments of the present invention is intended to be illustrative, and not to limit the scope of the claims, and many alternatives, modifications, and variations will be apparent to those skilled in the art. Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A photoreceptor unit comprising:

a photoconductive drum assembly;

a housing to enclose the photoconductive drum assembly to be rotatable therein;

a handgrip rotatably connected to the housing; and a stopper placed at a predetermined distance from a hinge point of the handgrip to prevent the housing with the photoconductive drum assembly from becoming lopsided toward a preponderant side of the housing with respect to a center of rotation of the handgrip when the housing is lifted up by the handgrip.

2. The photoreceptor unit according to claim 1, wherein the stopper comprises:

a step section formed on the housing to protrude from an outer surface of the housing; and a stopping curb provided on the handgrip to correspond to the step section.

3. The photoreceptor unit according to claim 2, wherein the step section and the stopping curb contact each other at a side of the housing opposite to an eccentric center of gravity of the housing based on the center of rotation of the handgrip.

4. The photoreceptor unit according to claim 2, wherein the handgrip comprises:

a grip bar formed in a bar shape with a grip section; and a pair of link bars perpendicularly extending from both ends of the grip bar and rotatably connected to both sides of the housing, and the stopping curb is formed on at least one of the link bars.

5. The photoreceptor unit according to claim 4, wherein the link bars comprise a bent portion being bent at a predetermined angle in their longitudinal direction, and the stopping curb is formed at the bent portion.

6. The photoreceptor unit according to claim 1, wherein:

the housing comprises, opposing first and second vertical walls to rotatably support the photoconductive drum assembly, and a protective wall to connect the vertical walls to surround an outer periphery of the photoreceptor drum assembly and to provide a plurality of openings; and the stopper comprises, a step section formed on the housing to protrude from the first vertical wall, and a stopping curb formed on the handgrip to correspond to the step section.

7. The photoreceptor unit according to claim 1, wherein the housing encloses a charging unit and a used toner recovering unit, a center of gravity of the housing is disposed on a side of housing provided with the charging unit and the used toner recovering unit, and the stopper operates on another side of the housing opposite to the center of gravity with respect to the center of rotation of the handgrip.

8. The photoreceptor unit according to claim 1, wherein the housing comprises fixed shafts displaced from the center of rotation of the photoconductive drum assembly and provided on both sides of the housing to rotatably support the handgrip.

9. The photoreceptor unit according to claim 8, further comprising:

brackets connected to both sides of the housing to prevent the handgrip from being separated from the fixed shafts.

10. The photoreceptor unit according to claim 1, further comprising:

a spring member to elastically support the handgrip to prevent the handgrip from being in close contact with the housing.

11. The photoreceptor unit according to claim 10, wherein the spring member comprises a plate spring provided on one side of the housing to elastically contact and support the handgrip.

12. The photoreceptor unit according to claim 11, further comprising:

a pair of brackets connected to both sides of the housing to prevent the separation of the handgrip from the housing, wherein the spring member is placed between the housing and at least one of the brackets.

13. The photoreceptor unit according to claim 10, further comprising:

a pair of brackets connected to both sides of the housing to prevent the separation of the handgrip from the housing, wherein the spring member is placed between the housing and at least one of the brackets.

14. The photoreceptor unit according to claim 13, further comprising:

a damping bar and a spring both provided within the bracket to elastically support a transfer unit mounted on a top of the housing.

15. The photoreceptor unit according to claim 10, wherein the handgrip is pressed down and comes close to the housing when a transfer unit is placed on a top of the housing inserted into an image forming apparatus, and the handgrip is slightly separated from the housing by a reaction force of the spring member when the transfer unit is separated.

16. A photoreceptor unit comprising:

a photoconductive drum assembly;

a housing to enclose the photoconductive drum assembly to be rotatable therein with respect to a rotation axis passing through opposite sides of the housing;

a handgrip rotatably connected to the opposite sides of the housing; and a spring member to resiliently support the handgrip to prevent the handgrip in a laid-down position from contacting the housing by its own weight.

17. The photoreceptor unit according to claim 16, wherein the spring member comprises a plate spring provided on one of the opposite sides of the housing to elastically contact and support the handgrip.

18. The photoreceptor unit according to claim 17, wherein the housing comprises a pair of brackets connected to both sides thereof to prevent the separation of the handgrip from the housing, and the spring member is placed between the housing and at least one of the brackets.

19. The photoreceptor unit according to claim 16, wherein the housing comprises a pair of brackets connected to both sides thereof to prevent the separation of the handgrip from the housing, and the spring member is placed between the housing and at least one of the brackets.

20. The photoreceptor unit according to claim 16, further comprising:

a stopper to prevent the housing with the photoconductive drum assembly from becoming lopsided toward a preponderant side of the housing based on a center of rotation of the handgrip when the housing is lifted up by the handgrip.

21. The photoreceptor unit according to claim 20, wherein the stopper is spaced apart from a hinge point of the handgrip by a predetermined distance.

22. The photoreceptor unit according to claim 20, wherein the stopper comprises:

a step section formed on the housing to protrude from an outer surface of the housing; and a stopping curb provided on the handgrip and spaced from a hinge point of the handgrip by a predetermined distance to correspond to the step section.

23. The photoreceptor unit according to claim 20, wherein the handgrip comprises a bent portion bent at a predetermined distance from a hinge point.

24. A photoreceptor unit used with an image forming apparatus, comprising:

a housing having a photoconductive drum assembly;

a handgrip rotatably connected to the housing;

a stopper formed on at least one of the handgrip and the housing to prevent the housing from rotating with respect to a hinge point of the handgrip; and an elastic member disposed between the housing and the handgrip to elastically control a distance between the handgrip and the housing.

25. The photoreceptor unit according to claim 24, wherein the handgrip is disposed in a rest position according to an elastic force of the elastic member and in a lifting position according to a stopping operation of the stopper on the at least one of the handgrip and the housing.

26. The photoreceptor unit according to claim 24, wherein the housing has a center of gravity which does not coincide with a rotation center of the photoconductive drum assembly.

27. The photoreceptor unit according to claim 24, wherein the housing comprises a charging unit to control a potential of the photoconductive drum assembly and has a center of gravity which does not coincide with a rotation center of the photoconductive drum assmebly, and the handgrip has a center of rotation corresponding to the hinge point spaced apart from the center of gravity of the housing by a predetermined distance.

28. The photoreceptor unit according to claim 27, wherein the stopper is disposed on a side of the housing opposite to the center of gravity of the housing with respect to the center of the rotation.

29. The photoreceptor unit according to claim 27, wherein the housing comprises a used toner recovering unit, the center of gravity of the housing is disposed apart from a rotation center of the photoconductive drum assembly, and the center of rotation of the handgrip is disposed apart from a rotation center of the photoconductive drum assembly.

30. The photoreceptor unit according to claim 24, wherein the handgrip comprises a grip bar disposed parallel to a lengthwise direction of the housing, and a pair of link bars extending from respective ends of the grip bar to be coupled to sides of the housing, respectively.

31. The photoreceptor unit according to claim 30, wherein each link bar comprises a first portion extending from the corresponding end of the grip bar in a direction different from a radial direction of the hinge point, a second portion extending from the first portion toward the hinge point, and a bent portion formed between the first and second portions.

32. The photoreceptor unit according to claim 31, wherein the second portion is formed in a direction parallel to the radial direction of the hinge point.

33. The photoreceptor unit according to claim 24, wherein the handgrip is disposed one of a first position in which the elastic member is compressed by an external force, a second position in which the elastic member is not compressed when the external force is removed, and a third position in which the stopper prevents the housing and the handgrip from rotating with respect to each other.

34. An image forming apparatus comprising:

a photoreceptor unit comprising, a housing having a photoconductive drum assembly, a handgrip rotatably connected to the housing, a stopper formed on at least one of the handgrip and the housing to prevent the housing from rotating with respect to a hinge point of the handgrip, and an elastic member disposed between the housing and the handgrip to elastically control a distance between the handgrip and the housing; and a transfer unit disposed on the photoreceptor unit.

35. The image forming apparatus according to claim 34, wherein the photoreceptor unit comprises a damping member to provide an elastic force between the photoreceptor unit and the transfer unit when the transfer unit is disposed on a top of the photoreceptor unit.

36. The image forming apparatus according to claim 34, wherein the transfer unit is inserted into the image forming apparatus in the same direction as the photoreceptor unit to be disposed on a top of the photoreceptor unit.

37. The image forming apparatus according to claim 34, wherein the handgrip comprises a grip bar and is disposed in one of a first position in which the grip bar maintains a first distance with the housing, a second position in which the grip bar maintains a second distance with the housing, and a third position in which the grip bar maintains a third distance with the housing, and the third distance is greater than the second distance which is greater than the first distance.

38. The image forming apparatus according to claim 37, wherein the handgrip moves toward one of the first position and the second position according to a movement of the transfer unit.

39. The image forming apparatus according to claim 37, wherein the handgrip moves from first position to the second position according to an elastic force of the elastic member.

40. The image forming apparatus according to claim 37, wherein the handgrip moves from the first position to the second position when the transfer unit is removed from the image forming apparatus.

41. The image forming apparatus according to claim 37, wherein the handgrip moves from the second position to the third position when the photoreceptor unit is lifted up from the image forming apparatus.

42. The image forming apparatus according to claim 41, wherein the stopper prevents the handgrip from rotating with respect to the photoreceptor unit according to a stopping operation of the stopper when the handgrip is in the third position.

43. A photoreceptor unit comprising:

a photoconductive drum assembly;

a housing having a first portion to partially surround the photoconductive drum assembly rotatably installed therein, and having a second portion through which the photoconductive drum assembly is exposed;

a handgrip rotatably connected to the first part of the housing; and a stopper to prevent the housing from being lopsided due to a difference between a center of rotation of the handgrip and a gravity center of a combination of the housing with the photoconductive drum assembly.

44. A photoreceptor unit comprising:

a photoconductive drum assembly;

a housing having a center portion and a side portion to enclose the photoconductive drum assembly to be rotatable therein;

a handgrip rotatably connected to the side portion of the housing to rotate with respect to an axis parallel to a rotation axis of the photoconductive drum assembly; and a plate spring provided on the side portion of the housing to resiliently support the handgrip to prevent the handgrip in a laid-down position from contacting the housing by its own weight.

* * * * *